US011137208B2

(12) United States Patent
Osa et al.

(10) Patent No.: US 11,137,208 B2
(45) Date of Patent: Oct. 5, 2021

(54) HEATING DEVICE AND HEATING METHOD, EACH OF WHICH USES SUPERHEATED STEAM

(71) Applicants: CHUBU ELECTRIC POWER CO., INC., Aichi (JP); YUTAKA ELECTRONICS INDUSTRY CO., LTD., Aichi-ken (JP)

(72) Inventors: Noburo Osa, Nagoya (JP); Yukinori Imamura, Kariya (JP); Takehito Uebayashi, Kariya (JP)

(73) Assignees: CHUBU ELECTRIC POWER CO., INC., Aichi (JP); YUTAKA ELECTRONICS INDUSTRY CO., LTD., Aichi-ken (JP)

( * ) Notice: Subject to any disclaimer, the term of this patent is extended or adjusted under 35 U.S.C. 154(b) by 282 days.

(21) Appl. No.: 16/473,605

(22) PCT Filed: Sep. 18, 2018

(86) PCT No.: PCT/JP2018/034391
§ 371 (c)(1),
(2) Date: Jun. 25, 2019

(87) PCT Pub. No.: WO2019/059159
PCT Pub. Date: Mar. 28, 2019

(65) Prior Publication Data

US 2021/0131731 A1 May 6, 2021

(30) Foreign Application Priority Data

Sep. 19, 2017 (JP) ..... JP2017-179067

(51) Int. Cl.
*F26B 21/00* (2006.01)
*F26B 21/10* (2006.01)

(52) U.S. Cl.
CPC ..... *F26B 21/004* (2013.01); *F26B 21/005* (2013.01); *F26B 21/001* (2013.01); *F26B 21/10* (2013.01)

(58) Field of Classification Search
CPC .... F26B 21/004; F26B 21/005; F26B 21/001; F26B 21/10
(Continued)

(56) References Cited

U.S. PATENT DOCUMENTS 5,588,223 A * 12/1996 Marshall ..... D21F 5/181 34/111
5,845,415 A * 12/1998 Sundqvist ..... D21F 5/187 34/452
(Continued)

FOREIGN PATENT DOCUMENTS

CN 102345974 A 2/2012
CN 105115256 A 12/2015
(Continued)

OTHER PUBLICATIONS

International Search Report for PCT/JP2018/034391, dated Nov. 6, 2018.

*Primary Examiner* — Stephen M Gravini
(74) *Attorney, Agent, or Firm* — Marshall, Gerstein & Borun LLP

(57) ABSTRACT

A heating device includes a hermetic container configured to accommodate a heatable object, a nozzle that supplies superheated steam into the hermetic container, a partition plate that separates a supplying region for the superheated steam from a heating region where the heatable object is heated in the hermetic container, an opening arranged in the partition plate, the opening allowing the superheated steam to be blown from the supplying region toward the heatable object in the heating region, an electric heater that heats the superheated steam in the supplying region, and a circulation
(Continued)

mechanism that circulates the superheated steam from the supplying region to the heating region.

9 Claims, 5 Drawing Sheets

(58) Field of Classification Search
USPC ..... 34/78
See application file for complete search history.

(56) References Cited

U.S. PATENT DOCUMENTS

| | | | | | |
|---|---|---|---|---|---|
| 5,915,815 | A * | 6/1999 | Moore | F26B 11/049 | 34/305 |
| 6,119,362 | A * | 9/2000 | Sundqvist | D21F 5/18 | 34/120 |
| 6,899,097 | B1 * | 5/2005 | Mecham | F02C 1/05 | 126/591 |
| 8,572,862 | B2 * | 11/2013 | TeGrotenhuis | D06F 58/206 | 34/82 |
| 9,096,079 | B2 * | 8/2015 | Priebe | B41J 11/002 | |
| 9,546,805 | B2 * | 1/2017 | Herbert | F25B 39/04 | |
| 10,429,062 | B2 * | 10/2019 | Wells | F22G 5/20 | |
| 10,533,799 | B2 * | 1/2020 | Triglia, Jr. | F26B 13/008 | |
| 2008/0116621 | A1 | 5/2008 | Brennan et al. | | |
| 2019/0255743 | A1 * | 8/2019 | Matsumoto | B29C 35/049 | |
| 2021/0131313 | A1 * | 5/2021 | Stankovic | F01K 23/10 | |
| 2021/0131731 | A1 * | 5/2021 | Osa | F26B 21/004 | |

FOREIGN PATENT DOCUMENTS

| | | | | |
|---|---|---|---|---|
| EP | 2612095 | B1 * | 4/2017 | F25B 39/04 |
| EP | 3552789 | A1 * | 10/2019 | B29C 35/049 |
| JP | 2006-226561 | A | 8/2006 | |
| JP | 2011-080658 | A | 4/2011 | |
| JP | 2019142065 | A * | 8/2019 | B29B 13/02 |
| JP | 6572464 | B2 * | 9/2019 | F26B 21/00 |
| JP | WO2019059159 | A1 * | 11/2019 | F26B 21/00 |
| KR | 2015-0131561 | A | 11/2015 | |
| WO | WO-2012028398 | A1 * | 3/2012 | F25B 40/00 |
| WO | WO-2019059159 | A1 * | 3/2019 | F26B 21/00 |

* cited by examiner

HEATING DEVICE AND HEATING METHOD, EACH OF WHICH USES SUPERHEATED STEAM

TECHNICAL FIELD

The present invention relates to a heating device and a heating method using superheated steam for evenly heating a plate-shaped workpiece made of synthetic plastic, such as carbon fiber reinforced plastic (CFRP) or glass fiber reinforced plastic (GFRP), within a short period of time.

BACKGROUND

Heating a plate-shaped workpiece with a thickness of approximately 1 mm to 10 mm to 200° C. to 500° C. in a combustion gas furnace requires approximately one hour. In this case, combustion gas is emitted while remaining high in temperature. Thus, the thermal efficiency is low. Further, the workpiece, which is made of synthetic plastic, may be burned. Heating devices such as an infrared heating device and an IH heating device are known for eliminating such disadvantages. The use of these heating devices shortens the heating time to several minutes. However, it is difficult for these heating devices to evenly heat the entire workpiece without causing temperature variation. In addition, the possibility of the working piece being burned through excessive heating is not eliminated. To cope with such problems, a heating device using superheated steam has been employed.

Such a heating device using superheated steam includes, for example, a superheated steam drying device disclosed in Patent Document 1. The superheated steam drying device includes a heater device that overheats steam and an oven device that dries an electrodeposition-coated workpiece. More specifically, the superheated steam drying device keeps the temperature in the oven device at 170° C. and changes the concentration of steam in the oven device to heat the workpiece for twenty minutes so that the workpiece is heated and dried to a desired state.

PRIOR ART DOCUMENT

Patent Document

Patent Document 1: Japanese Laid-Open Patent Publication No. 2011-80658

SUMMARY OF THE INVENTION

Problems that the Invention Solves

In the prior-art superheated steam drying device of Patent Document 1, the workpiece needs to be kept in the oven device until the entire workpiece reaches a predetermined temperature in accordance with the concentration of the steam (30 vol % to 70 vol %). Thus, heating the entire workpiece to the predetermined temperature and drying the entire workpiece requires, for example, twenty minutes. As a result, the workpiece cannot be quickly heated in the prior-art superheated steam drying device. In addition, a sufficient heating time is necessary to evenly heat the entire workpiece so that the temperature of the workpiece reaches the predetermined temperature. Thus, it is difficult for the prior-art superheated steam drying device to enable both quick heating and even heating.

It is an objective of the present invention to provide a heating device and a heating method using superheated steam that enable both quick heating and even heating.

Means for Solving the Problem

To achieve the above-described objective, a heating device includes a hermetic container configured to accommodate a heatable object, a nozzle that supplies superheated steam into the hermetic container, a partition plate that separates a supplying region for the superheated steam from a heating region where the heatable object is heated in the hermetic container, an opening arranged in the partition plate, the opening allowing the superheated steam to be blown from the supplying region toward the heatable object in the heating region, an electric heater that heats the superheated steam in the supplying region, and a circulation mechanism that circulates the superheated steam from the supplying region to the heating region.

This allows the superheated steam supplied from the nozzle into the hermetic container to be heated by the electric heater in the supplying region and kept at a high temperature. The high-temperature superheated steam is delivered from the opening of the partition plate to the heating region and then blown toward the heatable object. Thus, the high-temperature superheated steam quickly heats the heatable object. At the same time, the entire heatable object is heated with its temperature increasing evenly.

Effect of the Invention

The heating device and the heating method using superheated steam according to the present invention enable both quick heating and even heating.

MODES FOR CARRYING OUT THE INVENTION

An embodiment according to the present invention will now be described in detail with reference to the drawings.

Figure 1:
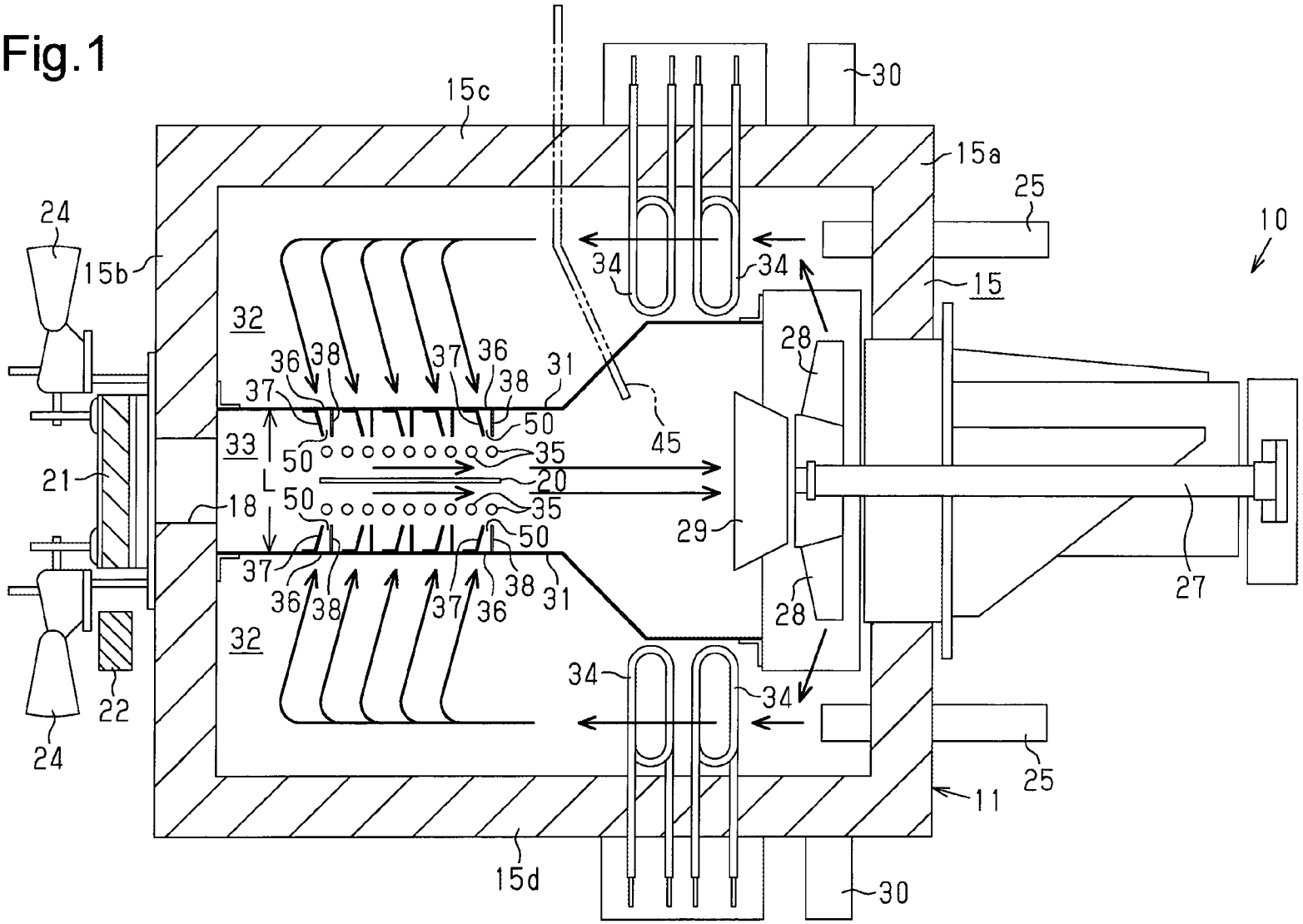
FIG. 1 is a schematic cross-sectional plan view entirely showing a heating device according to an embodiment of the present invention.
Figure 3:
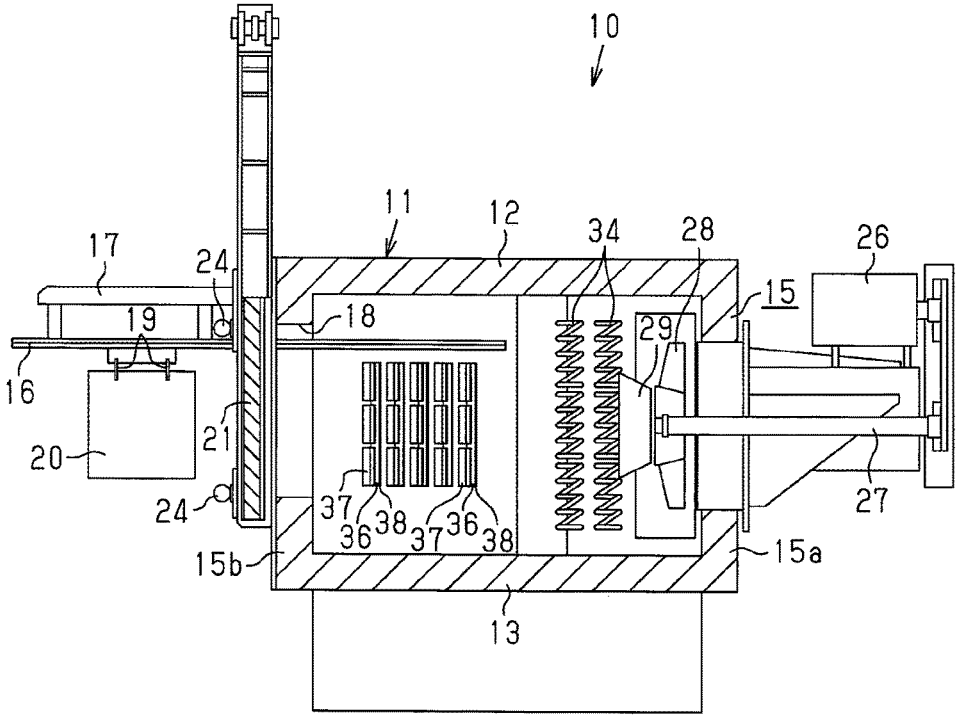
FIG. 3 is a right cross-sectional view schematically showing the entire heating device.

FIGS. 1 and 3 show a heating device 10 configured by a hermetic container 11. The hermetic container 11 includes a top wall 12, a bottom wall 13, and four side walls 15, namely, a front side wall 15*a* (right side in FIG. 1), a rear side wall 15*b* (left side in FIG. 1), a left side wall 15*c* (upper side in FIG. 1), and a right side wall 15*d* (lower side in FIG. 1). These walls form the hermetic container 11 to be box-shaped.

As shown in FIG. 3, a support rail 16 is supported by a support frame 17 at the rear of the rear side wall 15*b* and extends from an insertion hole 18 of the rear side wall 15*b* to the central position of the hermetic container 11. A clamp 19 is coupled to the lower part of the support rail 16 to hold a plate-shaped workpiece 20, which serves as a heatable object. The workpiece 20 is a plate having a thickness of approximately 1 mm to 10 mm and made of, for example, synthetic plastic such as CFRP or GFRP, metal, or ceramic. The workpiece 20 has two surfaces located on the sides opposite to each other.

As shown in FIGS. 1 and 3, when the workpiece 20 is pressed into the hermetic container 11 with the workpiece 20 coupled to the clamp 19 of the support rail 16, the workpiece 20 is guided by the support rail 16 and inserted into the hermetic container 11 to reach a predetermined position. The heated workpiece 20 is guided by the support rail 16 and taken out from the hermetic container 11. The workpiece 20 is vertically supported at the central position in the sideward direction in the hermetic container 11 and located away from the rear side wall 15*b* toward the front by a predetermined distance.

Figure 4:
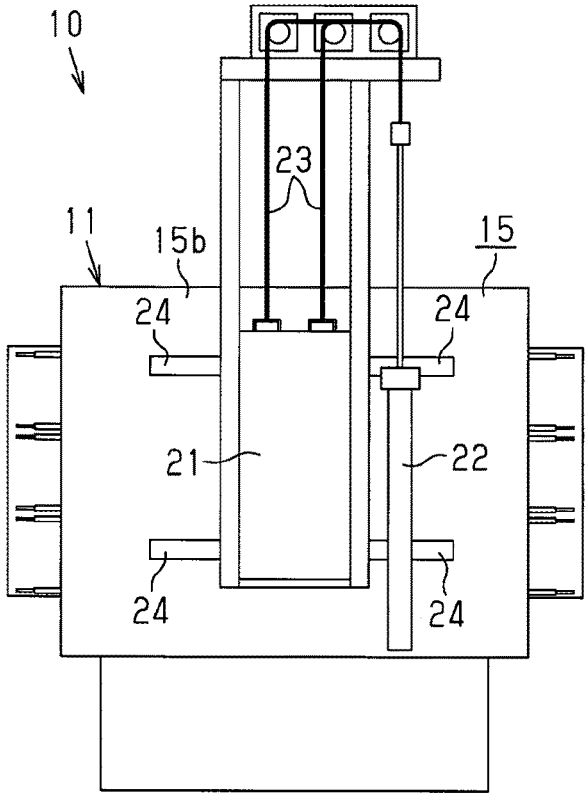
FIG. 4 is a front view schematically showing the entire heating device.

As shown in FIGS. 3 and 4, a shutter 21 arranged to face the insertion hole 18 is located at the rear of the rear side wall 15*b* and supported by a lifting cylinder 22 via wires 23 to be vertically movable. Further, four clamp cylinders 24 are arranged so that the shutter 21 is in close contact with the rear side wall 15*b*. After the workpiece 20 is inserted into the hermetic container 11 with the shutter 21 lifted through activation of the lifting cylinder 22, the clamp cylinders 24 cause the shutter 21 to be in close contact with the rear side wall 15*b* with the shutter 21 lowered to cover the insertion hole 18. As a result, the hermetic container 11 is sealed.

As shown in FIG. 1, two nozzles 25 that supply superheated steam into the hermetic container 11 are extended through and supported on the two sides of the front side wall 15*a*. Further, the two nozzles 25 respectively extend in parallel to the left side wall 15*c* and the right side wall 15*d*. The superheated steam (for example, 150° C. to 500° C., 0.2 MPa) supplied to the nozzles 25 is generated by heating, using a superheated steam generator, saturated steam (for example, 120° C., 0.2 MPa) generated in a boiler (not shown).

As shown in FIGS. 1 and 3, a rotation shaft 27 rotated and driven by a rotary motor 26 is supported at the central portion of the front side wall 15*a*, and fan blades 28 and a suction member 29 are coupled to the distal end of the rotation shaft 27. As shown by the arrows in FIG. 1, rotation of the fan blades 28 causes the superheated steam jetted out of the nozzles 25 to circulate in the hermetic container 11. In addition, the suction member 29, which rotates integrally with the fan blades 28, draws in the superheated steam to expedite the circulation of the superheated steam. The left side wall 15*c* and the right side wall 15*d* respectively include exhaust ducts 30. The exhaust ducts 30 are configured to emit gas containing the superheated steam in the hermetic container 11.

One partition plate 31 is arranged to face one of the two surfaces of the workpiece 20. Another partition plate 31 is arranged to face the other one of the two surfaces of the workpiece 20. The two partition plates 31 are paired with each other. The two partition plates 31 respectively located on the two sides of the workpiece 20 extend from the rear side wall 15*b* to the suction member 29. The partition plates 31 are arranged perpendicular to the rear side wall 15*b*. Each partition plate 31 is substantially crank-shaped. The partition plates 31 include portions extending in parallel to the workpiece 20 on the two sides of the workpiece 20, portions obliquely extending from the ends of the parallel portions toward the suction member 29 to increase in width respectively toward the left side wall 15*c* and the right side wall 15*d*, and portions extending in parallel to the left side wall 15*c* and the right side wall 15*d* in the vicinity of the suction member 29.

Figure 2:
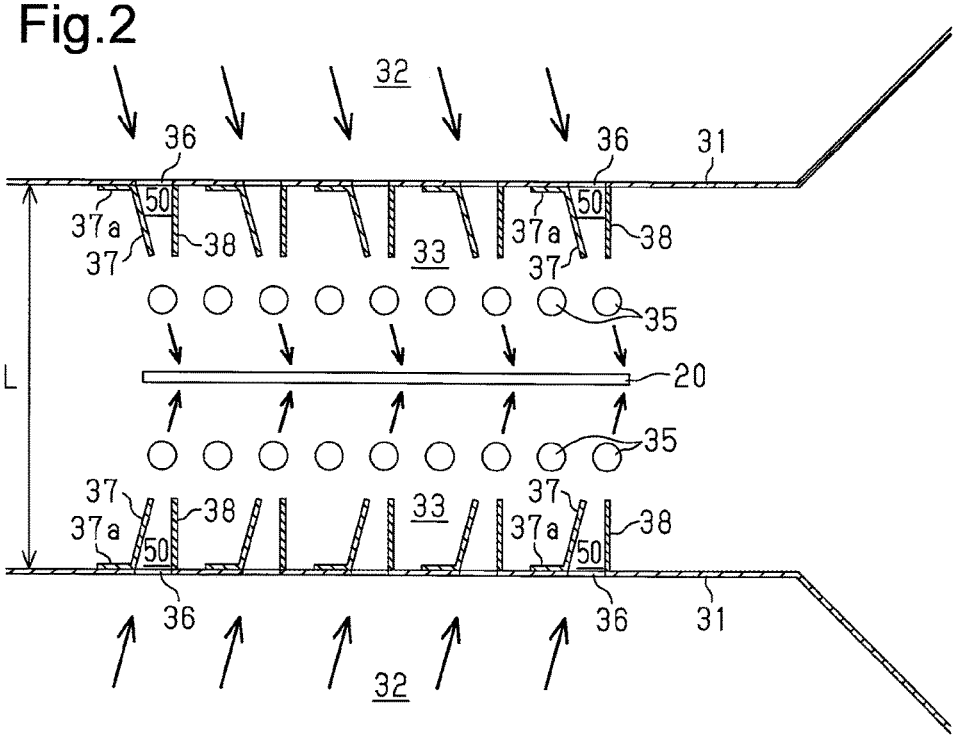
FIG. 2 is an enlarged cross-sectional plan view schematically showing the heating region of FIG. 1.

Referring to FIG. 2, it is desired that a distance L between the two partition plates 31 be minimized in order to increase the flow speed of superheated steam on the two surfaces of the workpiece 20. More specifically, the distance L is preferably 10 mm to 300 mm and more preferably 30 mm to 100 mm. When the distance L between the partition plates 31 is less than 10 mm, the space between the two partition plates 31 is too narrow. In this case, arranging the workpiece 20 in the space may be difficult. When the distance L between the partition plates 31 is greater than 300 mm, the flow speed of superheated steam on the two surfaces of the workpiece 20 cannot be sufficiently increased. As a result, the temperature-increasing time may not be able to be shortened.

As shown in FIG. 1, the space between one of the partition plates 31 and the left side wall 15*c* and the space between the other one of the partition plates 31 and the right side wall 15*d* are supplying regions 32 for superheated steam, and the space between the two partition plates 31 and the workpiece 20 is a heating region 33, where the workpiece 20 is heated by superheated steam. The supplying regions 32 for the superheated steam respectively include two first electric heaters 34 arranged in a coiled manner. The first electric heaters 34 heat the superheated steam supplied from the nozzles 25 to the hermetic container 11 to keep the superheated steam at a high temperature. In addition, the heating region 33, where heating is performed by the superheated steam, includes second electric heaters 35 arranged on the two sides of the workpiece 20 to face each other.

Figure 5:
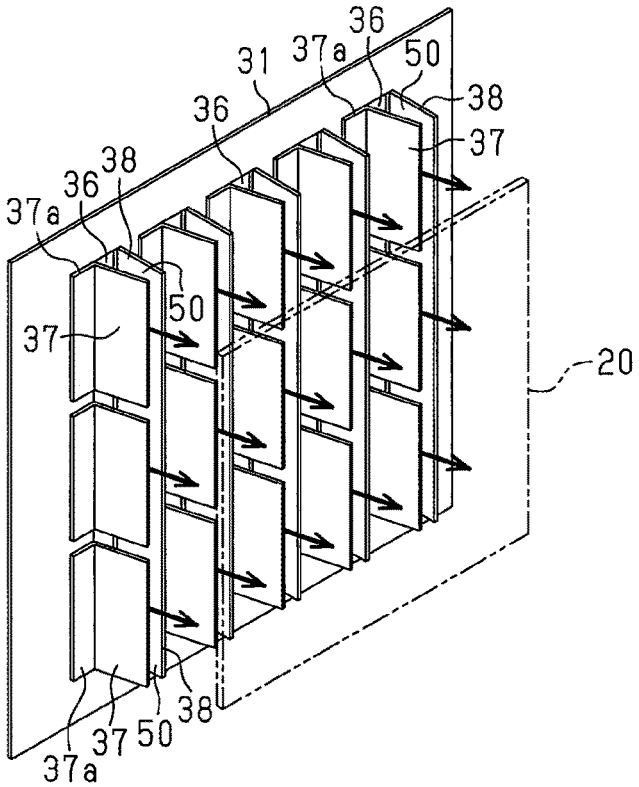
FIG. 5 is a perspective view showing the relationship between slits and flow-regulating plates of a partition plate with a plate-shaped workpiece.

As shown in FIG. 5, each partition plate 31 has slits 36, which serve as openings. The slits 36 have the same shape and open in a vertically-long rectangular form. Five slits 36 are evenly arranged in a horizontal manner to face the workpiece 20. This allows superheated steam to pass through the slits 36 and be blown evenly against the entire workpiece 20. It is preferred that the number of the slits 36 be approximately three to one hundred in accordance with the area and material of the workpiece 20.

Figure 6:
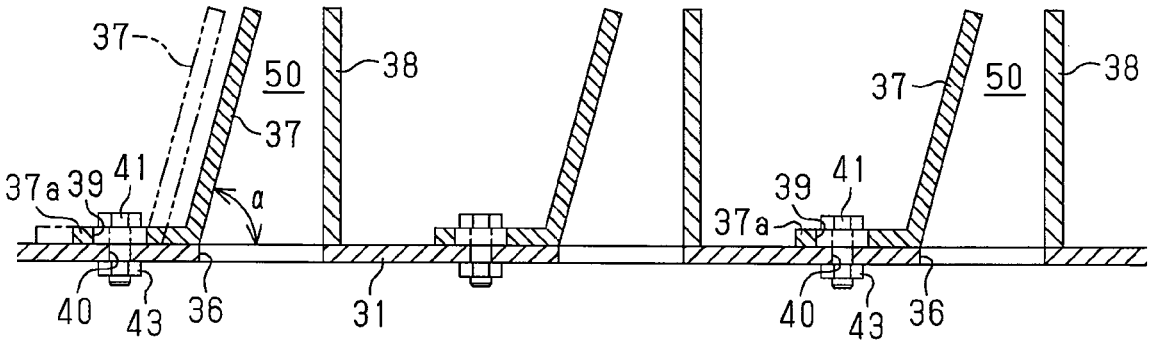
FIG. 6 is an enlarged cross-sectional view showing the structures of first flow-regulating plates and second flow-regulating plates arranged at portions of the slits of the partition plate.

As shown in FIGS. 5 and 6, first flow-regulating plates 37 and second flow-regulating plates 38 extend to protrude from the surface of each partition plate 31 facing the heating region 33. The first flow-regulating plates 37 and the second flow-regulating plate 38 are arranged respectively on the rear side and the front side along the two sides of each slit 36 of the partition plate 31. Each first flow-regulating plate 37 is formed by bending a board 37*a* such that an inclination angle $\alpha$ relative to the partition plate 31 is, for example, 75°. The board 37*a* has an elongated hole 39, and the partition plate 31 has a through-hole 40. A bolt 41 is inserted through the through-hole 40 of the partition plate 31 from the elongated hole 39 of the board 37*a* and fastened to a nut 43. The bolt 41 is fixed to the nut 43 through tightening. It is preferred that the inclination angle α of the first flow-regulating plate 37 be set to be within a range from 10° to 80°.

As shown by the long dashed double-short dashed line in FIG. 6, after the nut 43 is unfastened from the bolt 41 to cause the board 37*a* of the first flow-regulating plate 37 to slide, the nut 43 is fastened to the bolt 41. This allows for expansion and contraction of a passage 50 for superheated steam between the first flow-regulating plate 37 and the second flow-regulating plate 38.

Each second flow-regulating plate 38 protrudes to be orthogonal to the partition plate 31. The basal end of each second flow-regulating plate 38 is joined to the partition plate 31 through welding. Thus, the passage 50 for superheated steam between the first flow-regulating plate 37 and the second flow-regulating plate 38 is configured such that the passage 50 is broad on the basal end and narrow on the distal end. This increases the flow speed of superheated steam that passes through the passage 50. The superheated steam flows from the supplying regions 32 through the slits 36, passes through the passages 50 between the first flow-regulating plates 37 and the second flow-regulating plates 38 into the heating region 33, and is strongly blown along the surface of the workpiece 20.

Referring to FIG. 1, it is desired that the average flow speed of superheated steam in the vicinity of the workpiece 20 be high in order to increase the efficiency of heat transfer to the workpiece 20 and allow the temperature of the workpiece 20 to increase at a high speed. The average flow speed of superheated steam is preferably greater than or equal to 1 m/s and more preferably 5 m/s. The upper limit of the average flow speed of superheated steam in the vicinity of the workpiece 20 depends on the design of the heating device 10 and is, for example, approximately 30 m/s.

The average flow speed of superheated steam can be calculated from the flow speed of atmospheric air in the hermetic container prior to the supply of the superheated steam. The distal end of an oxygen concentration meter 45 is inserted into a region in the vicinity of the suction member 29 of the heating region 33 to measure the oxygen concentration in the heating region 33. It is preferred that the oxygen concentration in the heating region 33 be set to 5 vol % in order to limit combustion of the workpiece 20 when the workpiece 20 is a synthetic plastic such as CFRP or GFRP. When it turns out that the oxygen concentration measured by the oxygen concentration meter 45 is greater than a predetermined value, the oxygen concentration can be controlled to be constantly low by increasing the opening degrees of the nozzles 25 to increase the supply amount of superheated steam. Such a control limits the combustion of the workpiece 20 when the workpiece 20 is made of a combustible plastic such as CFRP.

A temperature sensor may be arranged at a suitable position in the hermetic container 11 to adjust the temperatures in the supplying regions 32 and the heating region 33. Additionally, a thermocouple may be used to measure the temperature of the surface of the workpiece 20.

The operation of the heating device 10 according to the present embodiment will now be described.

Referring to FIG. 1, when the workpiece 20, which is made of a material such as CFRP or GFRP, is heated, the workpiece 20 is held using the clamp 19 and inserted into the hermetic container 11 to reach a predetermined position. Subsequently, the shutter 21 is closed to keep the hermetic container 11 sealed. In this state, as shown by the arrows in FIG. 1, superheated steam is blown from the two nozzles 25 into the hermetic container 11. Further, the fan blades 28 and the suction member 29 are rotated to cause the superheated steam to flow into the two supplying regions 32, pass through the slits 36 of each partition plate 31, and flow into the heating region 33.

In this case, the first electric heaters 34 are heated in each supplying region 32 to keep the superheated steam at a high temperature. The second electric heaters 35 are heated at positions in the heating region 33 proximate to the workpiece 20 so that the second electric heater 35 heats the superheated steam in the vicinity of the workpiece 20. In the heating region 33, the superheated steam is blown against the workpiece 20 to heat the workpiece 20. Then, the superheated steam is drawn into the suction member 29 and delivered again by the fan blades 28 into the two supplying regions 32. In this manner, the superheated steam circulates in the hermetic container 11.

The slits 36 are evenly arranged in each partition plate 31 to face the workpiece 20. This allows the superheated steam to pass through the slits 36 and to be evenly blown against the workpiece 20.

Further, the first flow-regulating plates 37 and the second flow-regulating plates 38 are respectively arranged on the two sides of each slit 36, and the second flow-regulating plates 38 are arranged orthogonal to each partition plate 31. The inclination angle α relative to the partition plate 31 of the first flow-regulating plate 37 is set to, for example, 75°. Thus, the passages 50 for superheated steam between the first flow-regulating plates 37 and the second flow-regulating plates 38 are narrower toward the distal ends of the passages 50. This increases the flow speed of the superheated steam that has passed through the slits 36. As a result, the superheated steam is strongly blown against the workpiece 20 to increase the speed of a temperature increase in the workpiece 20.

In addition, since the first flow-regulating plates 37 are inclined frontward relative to the partition plate 31, superheated steam flows frontward along the surface of the workpiece 20 toward the suction member 29. This further increases the speed of heating the entire workpiece 20.

Additionally, the second electric heaters 35 are evenly arranged to face the surface of the workpiece 20 respectively at the positions of the heating region 33 that are proximate to the two surfaces of the workpiece 20. Thus, the superheated steam is further heated by the second electric heaters 35 and blown against the workpiece 20. Moreover, electric heat of each second electric heater 35 directly heats the workpiece 20. This further expedites heating of the entire workpiece 20.

Heating of the workpiece 20 with superheated steam is performed through condensation heat transfer and forced-convection heat transfer of the superheated steam. Thus, the thermal conductivity is high. This allows the temperature of the entire workpiece 20 to be quickly increased.

Tests for checking the effects of quick heating and even heating of the workpiece 20 with the heating device 10 according to the above-described embodiment were conducted under the following conditions.

First, before superheated steam was supplied from the nozzles 25 into the hermetic container 11, the workpiece 20 was installed in the hermetic container 11. The flow speed (m/s) of the atmospheric air was measured under an atmosphere in the vicinity of the two surfaces of the workpiece 20 when the fan blades 28 and the suction member 29 were rotated with the sealed state of the hermetic container 11 kept under the following condition. The flow speed of superheated steam having a temperature of 380° C. was calculated by performing density conversion and temperature conversion for the measured value. The flow speed of the superheated steam was calculated as described above at nine positions of the workpiece. The result is shown in Table 1.

Workpiece: CFRP, Length 300 mm, Width 300 mm, Thickness 2 mm

Internal Volume of Hermetic Container 11: Length 1.134 m×Width 1.02 m×Height 0.78 m=0.90 $m^3$ Slits 36 of Partition plate 31: Five slits 36 were arranged evenly in the horizontal direction to face the workpiece 20. Each vertically-long slit 36 was set to a length of 350 mm and a width of 16 mm. The vertical length of the first flow-regulating plate 37 was set to 120 mm. The inclination angle α of the first flow-regulating plate 37 relative to the partition plate 31 was set to 75°. The vertical length of the second flow-regulating plate 38 was set to 350 mm. The inclination angle α of the second flow-regulating plate 38 relative to the partition plate 31 was set to 90°. The distance between the distal end of the first flow-regulating plate 37 and the distal end of the second flow-regulating plate 38 was set to 10 mm.

The distance L between the two partition plates 31 was set to 240 mm. The workpiece 20 was located at the middle of the distance L.

Supply Amount of Superheated Steam from Nozzles 25: 3.0 kg/h (Supply Amount of Saturated Steam)

First Electric Heaters 34: Coil heaters were used. The heaters on the left side wall 15*c* and the heaters on the right side wall 15*d* were heated at 24 kW. The second electric heaters 35 were not used.

In Test 1 and Test 2, superheated steam having a temperature of 350° C. was supplied from the nozzles 25 into the hermetic container 11. The temperature in the heating region 33 was set to 380° C. in Test 1 and 450° C. in Test 2. In Test 3, superheated steam having a temperature of 350° C. was supplied from the nozzles 25 into the hermetic container 11, and the temperature in the heating region 33 was set to 400° C.

Figure 7A:
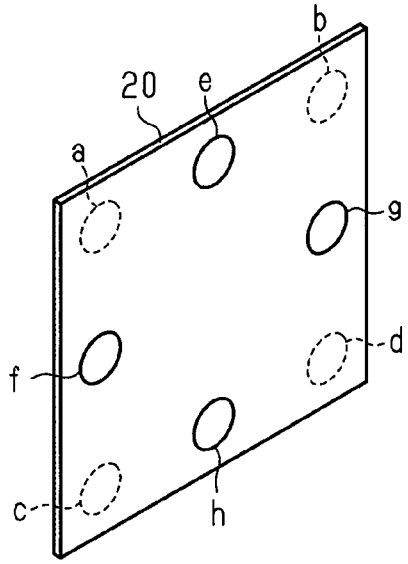
FIG. 7A is a perspective view showing the plate-shaped workpiece.

A heating time (s) for heating the workpiece 20 to a predetermined temperature was measured. Further, the temperatures at positions a to d (four corners on the left surface of the workpiece 20) and positions e to h (the middle positions of each side on the right surface of the workpiece 20) shown in FIG. 7A were measured by a thermocouple. These results are shown in Table 2. In Table 2, Δt (° C.) indicates the maximum one of the differences between the maximum value and the minimum value of the temperature ten seconds after the completion of heating at positions a to h.

TABLE 2

| | Heating | Temperature of Work Surface (° C.) | | | | | | | | Δt |
|---|---|---|---|---|---|---|---|---|---|---|
| | | Position of Work Surface | | | | | | | | |
| | Time (s) | a | b | c | d | e | f | g | h | (° C.) |
| Test 1 | 34 | 338 | 333 | 345 | 329 | 321 | 342 | 324 | 336 | 18 |
| Test 2 | 36 | 339 | 339 | 348 | 335 | 333 | 342 | 322 | 339 | 16 |
| Test 3 | 29 | 353 | 341 | 358 | 322 | 332 | 351 | 326 | 347 | 28 |

Rotation Speed of Fan Blades 28 and Suction Member 29: 2363 rpm (Motor 26: 60 Hz, 1793 rpm)

Figure 7B:
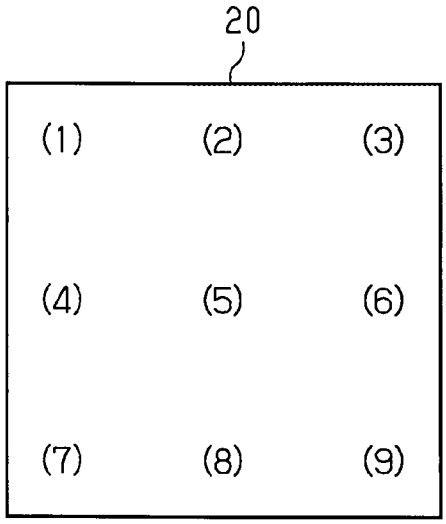
FIG. 7B is a front view showing the plate-shaped workpiece.

On the two surfaces of the workpiece 20, the flow speed of superheated steam was calculated at positions (1) to (9) shown in FIG. 7B.

TABLE 1

| | Flow Speed of Superheated Steam (m/s) | | | | | | | | |
|---|---|---|---|---|---|---|---|---|---|
| Position of Work | (1) | (2) | (3) | (4) | (5) | (6) | (7) | (8) | (9) |
| Right Surface of Work | 5.5 | 5.3 | 5.4 | 5.3 | 5.6 | 5.4 | 5.6 | 5.8 | 5.6 |
| Left Surface of Work | 5.5 | 5.7 | 6.0 | 5.3 | 5.4 | 5.8 | 5.3 | 5.7 | 5.9 |

As shown in Table 1, the flow speed of superheated steam produced by the fan blades 28 was set to be within a range from 5.3 m/s to 6.0 m/s.

Subsequently, the superheated steam was supplied from the nozzles 25 into the hermetic container 11 under the following condition, and the first electric heaters 34 were heated under the following condition. In this manner, the superheated steam was circulated by the fan blades 28 and the suction member 29 in the hermetic container 11. After the exhaust ducts 30 were initially opened to reduce the oxygen concentration in the hermetic container 11, the exhaust ducts 30 were closed. The subsequent oxygen concentration in the hermetic container 11 was measured by the oxygen concentration meter 45 to be 0.18 vol %.

As shown in Table 2, in Tests 1 to 3, the heating time of the workpiece 20 was 29 to 36 seconds. This increased the temperature of the workpiece 20 within a short period of time and allowed heating to be quickly performed. Further, the temperature difference at each position of the workpiece 20 was reduced to less than or equal to 30° C. This shows that the entire workpiece 20 can be evenly heated.

The above-described embodiment has the following advantages.

(1) The heating device 10 according to the embodiment includes the hermetic container 11, the nozzles 25 for superheated steam, the partition plates 31, each of which separates the supplying regions 32 from the heating region 33, the openings of the partition plates 31, the first electric heaters 34, which are arranged in the supplying regions 32, and the circulation mechanism.

Thus, high-temperature superheated steam heated by the first electric heaters 34 in the supplying regions 32 is blown from the opening toward the workpiece 20 in the heating region 33. This quickly heats the entire workpiece 20.

Accordingly, the heating device 10 according to the embodiment enables both quick heating and even heating of the workpiece 20. Thus, the heating device 10 is excellent in heat efficiency and thus can be reduced in size.

(2) The heatable object is the plate-shaped workpiece 20. The second electric heaters 35 are arranged at the positions proximate to the workpiece 20. Thus, superheated steam jetted out of the slit 36 to the heating region 33 is further increased in temperature by the second electric heaters 35 and blown against the workpiece 20. Further, the workpiece 20 is directly heated through electrical heat of the second electric heaters 35. This increases the heating efficiency of the workpiece 20.

(3) The openings are the slits 36, which are evenly arranged to face the workpiece 20. This allows superheated steam to be evenly blown from the slits 36 against the workpiece 20. Thus, even heating of the workpiece 20 is improved.

(4) The first flow-regulating plates 37 and the second flow-regulating plates 38 are arranged on the surface of each partition plate 31 facing the heating region 33. The first flow-regulating plates 37 and the second flow-regulating plates 38 cause superheated steam to be blown from the slits 36 toward the workpiece 20 and allow the superheated steam to pass through the slits 36 along the surface of the workpiece 20. This controls the direction of the superheated steam blown against the workpiece 20 and thus increases the heating efficiency of the workpiece 20.

(5) The partition plates 31 are arranged in a pair to face the two surfaces of the plate-shaped workpiece 20. This allows superheated steam to be blown simultaneously against the two surfaces of the workpiece 20, thereby expediting heating of the workpiece 20.

(6) The circulation mechanism includes the fan blades 28, which are rotated to cause superheated steam in the hermetic container 11 to circulate from the supplying region 32 to the heating region 33, and the suction member 29, which draws in some of the superheated steam in the heating region 33. This expedites circulation of the superheated steam in the hermetic container 11 and thus increases the heating efficiency of the workpiece 20.

(7) The hermetic container 11 includes the oxygen concentration meter 45, which measures the oxygen concentration in the hermetic container 11. Thus, the concentration of oxygen in the hermetic container 11 can be reduced by measuring the oxygen concentration. This limits combustion of the workpiece 20 that occurs when a combustible synthetic plastic is heated as the workpiece 20.

(8) The heating method using the heating device 10 is to heat the workpiece 20 by heating superheated steam delivered from the nozzles 25 to the supplying regions 32 using the first electric heaters 34 with the workpiece 20 arranged in the hermetic container 11 and by blowing the superheated steam, which has been heated to a high temperature, from the slits 36 of each partition plate 31 against the workpiece 20 in the heating region 33. This allows the high-temperature superheated steam to be blown against the workpiece 20 and enables both quick heating and even heating of the workpiece 20.

(9) The partition plates 31 are arranged in a pair to face the two surfaces of the plate-shaped workpiece 20. This allows the superheated steam to be blown from the slits 36 of each partition plate 31 against the two surfaces of the workpiece 20. This allows superheated steam to be blown simultaneously against the two surfaces of the workpiece 20, thereby expediting heating of the workpiece 20.

The above-described embodiment may be modified as follows.

Figure 8:
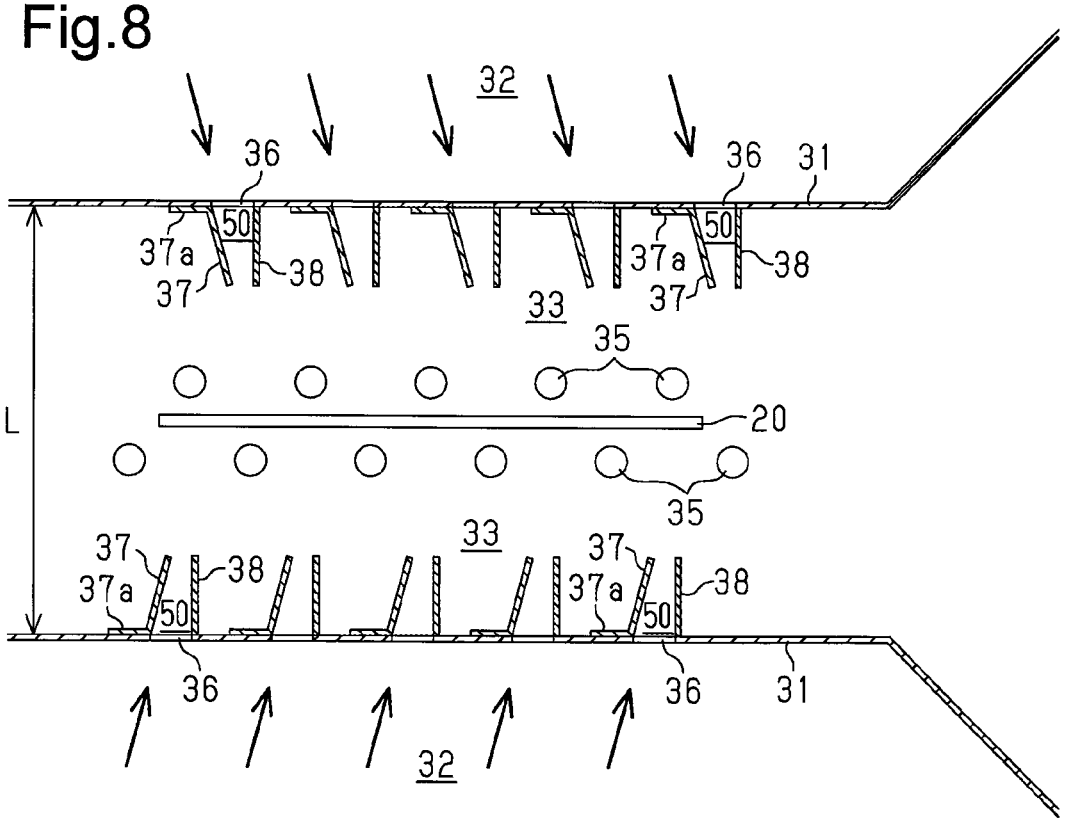
FIG. 8 is an enlarged cross-sectional plan view schematically showing the heating region in a modification of the present invention.

As shown in FIG. 8, the slits 36, the first flow-regulating plates 37, the second flow-regulating plates 38, and the second electric heaters 35, which are located on the two sides of the workpiece 20, may be arranged in a staggered manner. In this case, the heating efficiency of the workpiece 20 can be increased by reducing the number of the second electric heaters 35.

The cross-sectional shape of each slit 36 may be changed to, for example, square, circle, or oval in accordance with the size or material of the workpiece 20. The size of each slit 36 may be changed. The number and arrangement of the slits 36 may be changed.

In the above-described embodiment, each slit 36 may be evenly split into multiple sections in the vertical direction. For example, each slit 36 may be split into three sections. Additionally, each slit 36 may be formed to extend in the horizontal direction.

The second flow-regulating plate 38 may be inclined relative to each partition plate 31 in the same manner and in the same direction as the first flow-regulating plates 37 to direct the flow of superheated steam toward the suction member 29.

The openings do not have to be the slits 36. Instead, nozzles for jetting superheated steam may be used.

The workpiece 20 does not have to be plate-shaped. Instead, the workpiece 20 may be changed to various shapes such as column, pipe, and block. Additionally, the thickness or the like of the workpiece 20 does not have to be even and may include a curved portion or an uneven portion.

Superheated steam may be constantly supplied from the nozzles 25 by approximately 0.1% to 10% of a superheated steam circulation amount, and the same amount of superheated steam may be emitted from the exhaust ducts 30. In this case, a combustible matter that has evaporated from the synthetic plastic of the workpiece 20 is not concentrated into the hermetic container 11. As a result, the combustion of the combustible matter is limited.

The fan blades 28 and the suction member 29 may be located on the top wall 12 or the bottom wall 13 of the hermetic container 11.

When the workpiece 20 is left in the hermetic container 11 for a longer time than a predetermined time due to a fault or the like of the heating device 10, control can be performed to reduce the temperature in the hermetic container 11 by decreasing the output of the superheated steam generator and supplying superheated steam having a low temperature such as 150° C. to 250° C. from the nozzles 25 into the hermetic container 11. In this case, the workpiece 20 does not increase in temperature even when left in the hermetic container 11 for a long time due to a fault or the like. This restricts the workpiece 20 from changing in quality or being melted.

Instead of superheated steam, argon gas, inactive gas such as nitrogen gas, air, or a combination of inactive gas and air may be used as high-temperature fluid.

DESCRIPTION OF REFERENCE CHARACTERS

10) Heating Device; 11) Hermetic Container; 20) Workpiece serving as Heatable Object; 25) Nozzle; 28) Fan Blades configuring Circulation Mechanism; 29) Suction Member configuring Circulation Mechanism; 31) Partition Plate; 32) Supplying Region; 33) Heating Region; 34) First Electric Heater; 35) Second Electric Heater; 36) Slit serving as Opening; 37) First Flow-regulating Plate; 38) Second Flow-regulating Plate; 45) Oxygen Concentration Meter

The invention claimed is:

1. A heating device comprising:

a hermetic container configured to accommodate a heatable object;

a nozzle that supplies superheated steam into the hermetic container;

a partition plate that separates a supplying region for the superheated steam from a heating region where the heatable object is heated in the hermetic container;

an opening arranged in the partition plate, the opening allowing the superheated steam to be blown from the supplying region toward the heatable object in the heating region;

an electric heater that heats the superheated steam in the supplying region; and a circulation mechanism that circulates the superheated steam from the supplying region to the heating region.

2. The heating device according to claim 1, wherein:

the heatable object is a plate-shaped workpiece, and the heating device includes a second electric heater arranged at a position proximate to the workpiece.

3. The heating device according to claim 2, wherein the opening includes slits evenly arranged to face the workpiece.

4. The heating device according to claim 3, wherein:

the heating device includes a flow-regulating plate arranged on a surface of the partition plate facing the heating region, and the flow-regulating plate causes the superheated steam to blow from the slits toward the workpiece and pass along a surface of the workpiece.

5. The heating device according to claim 2, wherein:

the workpiece includes two surfaces, the partition plate is arranged to face one of the two surfaces of the workpiece, and the heating device includes an additional partition plate arranged to face the other one of the two surfaces of the workpiece and paired with the partition plate.

6. The heating device according to claim 1, wherein:

the circulation mechanism includes a fan blade that is rotated to circulate the superheated steam in the hermetic container from the supplying region to the heating region, and a suction member that draws in some of the superheated steam in the heating region.

7. The heating device according to claim 1, wherein the hermetic container includes an oxygen concentration meter that measures an oxygen concentration in the hermetic container.

8. A heating method using a heating device according to heat a heatable object, wherein the heating device includes:

a hermetic container configured to accommodate a heatable object, a nozzle that supplies superheated steam into the hermetic container, a partition plate that separates a supplying region for the superheated steam from a heating region where the heatable object is heated in the hermetic container, an opening arranged in the partition plate, the opening allowing the superheated steam to be blown from the supplying region toward the heatable object in the heating region, an electric heater that heats the superheated steam in the supplying region, and a circulation mechanism that circulates the superheated steam from the supplying region to the heating region, and the method comprises:

delivering the superheated steam from the nozzle to the supplying region in the hermetic container with the heatable object arranged in the hermetic container;

heating the superheated steam using the electric heater in the supplying region; and guiding the superheated steam, which has been heated to a high-temperature, from the opening of the partition plate to the heating region to blow the superheated steam against the heatable object.

9. The heating method according to claim 8, wherein:

the heatable object is a plate-shaped workpiece, the workpiece includes two surfaces, the partition plate is arranged to face one of the two surfaces of the workpiece, the heating device includes an additional partition plate arranged to face the other one of the two surfaces of the workpiece and paired with the partition plate, and the superheated steam is blown toward the two surfaces of the workpiece from the opening of each of the partition plate and the additional partition plate.

* * * * *